US007475652B2

(12) United States Patent
Dvorak

(10) Patent No.: US 7,475,652 B2
(45) Date of Patent: Jan. 13, 2009

(54) COLLAPSIBLE BOAT BOARDING PLATFORM

(76) Inventor: Ryan Dvorak, 1751 Industrial Blvd., Lake Havasu City, AZ (US) 84603

( * ) Notice: Subject to any disclaimer, the term of this patent is extended or adjusted under 35 U.S.C. 154(b) by 191 days.

(21) Appl. No.: 11/674,290

(22) Filed: Feb. 13, 2007

(65) Prior Publication Data

US 2007/0186840 A1 Aug. 16, 2007

Related U.S. Application Data

(60) Provisional application No. 60/773,052, filed on Feb. 13, 2006.

(51) Int. Cl.

| | |
|---|---|
| ***B63B 27/14*** | (2006.01) |
| ***E04G 3/10*** | (2006.01) |
| ***E06C 1/38*** | (2006.01) |
| ***E06C 1/39*** | (2006.01) |
| ***E06C 5/00*** | (2006.01) |

(52) U.S. Cl. ..... 114/362; 182/95; 182/150; 182/152; 182/156

(58) Field of Classification Search ..... 114/343, 114/362, 364; 182/95–97, 150, 152, 156, 182/163, 164

See application file for complete search history.

(56) References Cited

U.S. PATENT DOCUMENTS

| | | | | |
|---|---|---|---|---|
| 3,693,573 | A | | 9/1972 | Murphy |
| 4,495,883 | A | | 1/1985 | Hoy |
| 4,911,264 | A | * | 3/1990 | McCafferty ..... 182/92 |
| 5,537,949 | A | | 7/1996 | Blevins et al. |
| 5,586,516 | A | | 12/1996 | Hagen et al. |

* cited by examiner

*Primary Examiner*—Ajay Vasudeva
(74) *Attorney, Agent, or Firm*—Alvin V. Fashu-Kanu; Procopio, Cory, Hargreaves & Savitch LLP

(57) ABSTRACT

The present invention is directed to a boarding platform for a boat that includes all of the stability of a permanent swim platform as well as the capability of being adjusted and adapted so that it can be set up at virtually any location on the boat. The boarding platform requires no additional hardware and affords the convenience of easy set up, removal, and storage.

13 Claims, 5 Drawing Sheets

COLLAPSIBLE BOAT BOARDING PLATFORM

CROSS REFERENCE TO RELATED APPLICATIONS

This application claims priority to and herein incorporates by reference U.S. Provisional Patent Application No. 60/773,052 entitled "COLLAPSIBLE BOAT BOARDING PLATFORM," filed on Feb. 13, 2006.

FIELD OF THE INVENTION

The present invention relates generally to boat boarding ladders and more particularly to a universal, adjustable, collapsible boat boarding platform for use on a variety of different boat styles and sizes.

BACKGROUND

Boarding and disembarking a boat from the water or while beached on a shoreline has often proved difficult. The ability to move on and off the boat easily during an outing is an essential aspect for swimming or ferrying passengers back and forth to shore. A sturdy platform to gain access up the side of the boat can make or break the boating experience. Its importance can be gauged by the many efforts to provide a ladder or platform for this purpose.

Current schemes use essentially two mechanisms for boarding and disembarking a boat. One mechanism uses a temporary boarding ladder. Another mechanism uses a permanently mounted swim platform and ladder.

Temporary boarding ladders can be split into two types; rope style and solid frame hook style. Rope style ladders are easy to store and require no mounting hardware but require the talents of a gymnast to ascend successfully. They have no center or bottom stability and swing easily on a curved hull, making them all but impossible for those with limited physical ability to ascend. They also have narrow ladder rungs which make them treacherous to mount from a bobbing dingy or shore boat.

Hook style ladders provide a solid frame but still have the narrow rung affliction. In addition, the hook style top can only be mounted over the gunnel or sides of the boat. Mounting a hook style ladder over the gunnel or the side of the boat drastically limits the locations where a hook style ladder can be used. Some ladder styles afford permanent mounting brackets, limiting location further.

Permanently mounted swim platforms provide greatly improved stability and usefulness, but as implied, are permanently located in one spot (usually the transom) and are unable to be easily relocated or adjusted thus limiting locations from which to board the boat. Side mounting is typically not available because it would get in the way during docking.

SUMMARY

It would be particularly useful to provide a boarding platform with all the stability of a permanent swim platform and the ability to be adjusted and to adapt to virtually any location on the boat. It requires no additional hardware and affords the convenience of storage.

Therefore, it is the object of this invention to provide a greatly improved boat boarding platform comprising a tubular frame and solid step plate capable of collapsing down for storage. A plurality of adjustment rods allowing the platform to be positioned in a level plane on most any hull angle and rope hangers to allow raising and lowering the platform to desired height.

According to one embodiment of the present invention first and a second vertically extending tubular side panels are arranged in parallel to one another, a portion of the first and the second vertically extending tubular side panels extending in an outward direction and having an opening on a side opposite to the outward direction and at least locking hole in the outward direction. The first and second sliding adjustment rods have diameters which are smaller than the openings, each of the first and second sliding adjustment rods have at least one button lock on an end configured to mate with the at least one locking hole.

An upper frame back rail is provided, which has a first connection to an upper portion of the first vertically extending tubular side panel and a second connection to an upper portion of the second vertically extending tubular side panel, the first connection including a first hinging member disposed to pivot in an inward direction toward the second vertically extending tubular side panel and the second connection including a second hinging member disposed to pivot in an inward direction toward the first vertically extending tubular side panel.

A lower frame back rail is provided, which has a third connection to a lower portion of the first vertically extending tubular side panel and a fourth connection to a lower portion of the second vertically extending tubular side panel, the third connection including a third hinging member disposed to pivot in an inward direction toward the second vertically extending tubular side panel and the fourth connection including a fourth hinging member disposed to pivot in an inward direction toward the first vertically extending tubular side panel.

A first and a second threaded stud may also be provided, the first threaded stud located in the outward direction on the first vertically extending tubular side panel, the second threaded stud located in the outward direction on the second vertically extending tubular side panel. A step plate, which has a first mounting hole on a first side of the step plate and a second mounting hole on a second side of the step plate is positioned so that the first mounting hole is configured to be aligned with the first threaded stud and the second mounting hole is configured to be aligned with the second threaded stud.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a collapsible boat boarding platform. According to an embodiment, first and a second vertically extending tubular side panels are arranged in parallel to one another, a portion of the first and the second vertically extending tubular side panels extending in an outward direction and having an opening on a side opposite to the outward direction and at least locking hole in the outward direction. The first and second sliding adjustment rods have diameters which are smaller than the openings, each of the first and second sliding adjustment rods have at least one button lock on an end configured to mate with the at least one locking hole.

An upper frame back rail is provided, which has a first connection to an upper portion of the first vertically extending tubular side panel and a second connection to an upper portion of the second vertically extending tubular side panel, the first connection including a first hinging member disposed to pivot in an inward direction toward the second vertically extending tubular side panel and the second connection including a second hinging member disposed to pivot in an inward direction toward the first vertically extending tubular side panel.

A lower frame back rail is provided, which has a third connection to a lower portion of the first vertically extending tubular side panel and a fourth connection to a lower portion of the second vertically extending tubular side panel, the third connection including a third hinging member disposed to pivot in an inward direction toward the second vertically extending tubular side panel and the fourth connection including a fourth hinging member disposed to pivot in an inward direction toward the first vertically extending tubular side panel.

A first and a second threaded stud may also be provided, the first threaded stud located in the outward direction on the first vertically extending tubular side panel, the second threaded stud located in the outward direction on the second vertically extending tubular side panel. A step plate, which has a first mounting hole on a first side of the step plate and a second mounting hole on a second side of the step plate is positioned so that the first mounting hole is configured to be aligned with the first threaded stud and the second mounting hole is configured to be aligned with the second threaded stud.

After reading this description it will become apparent to one skilled in the art how to implement the invention in various alternative embodiments and alternative applications. However, although various embodiments of the present invention are described herein, it is understood that these embodiments are presented by way of example only, and not limitation. As such, this detailed description of various alternative embodiments should not be construed to limit the scope or breadth of the present invention as set forth in the appended claims.

Figure 2:
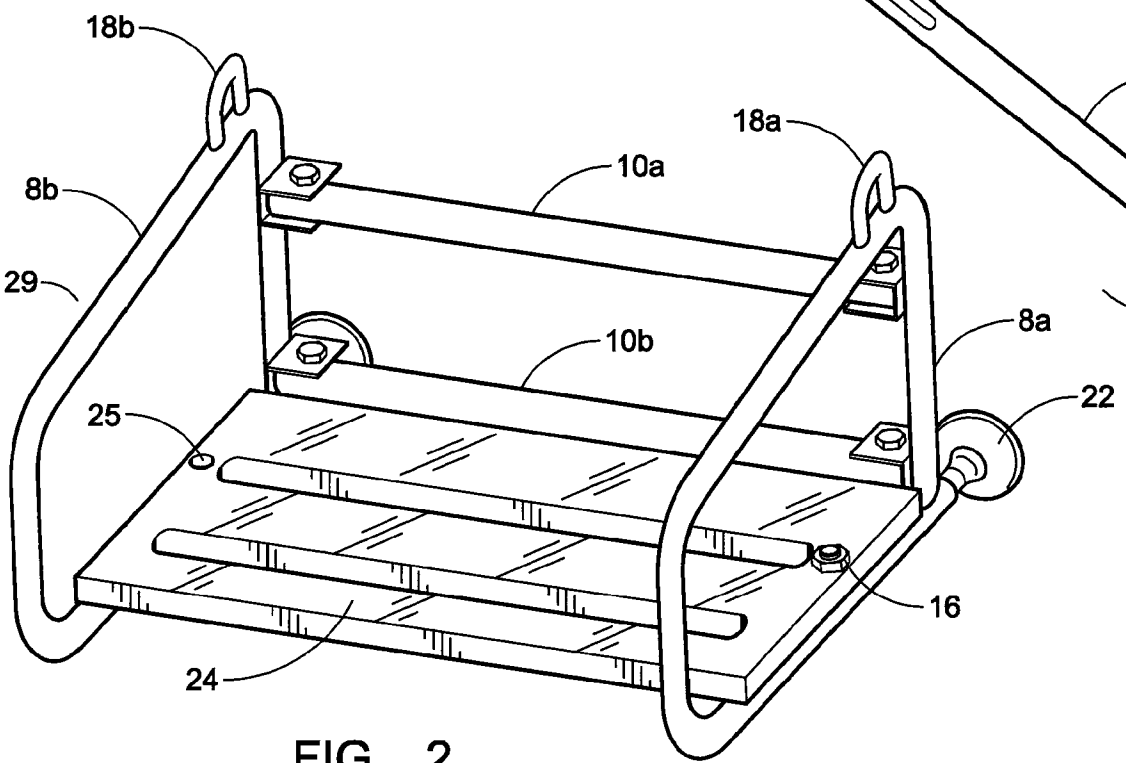
FIG. 2 is a diagram showing a collapsible boat boarding platform according to an embodiment of the present invention.
Figure 5:
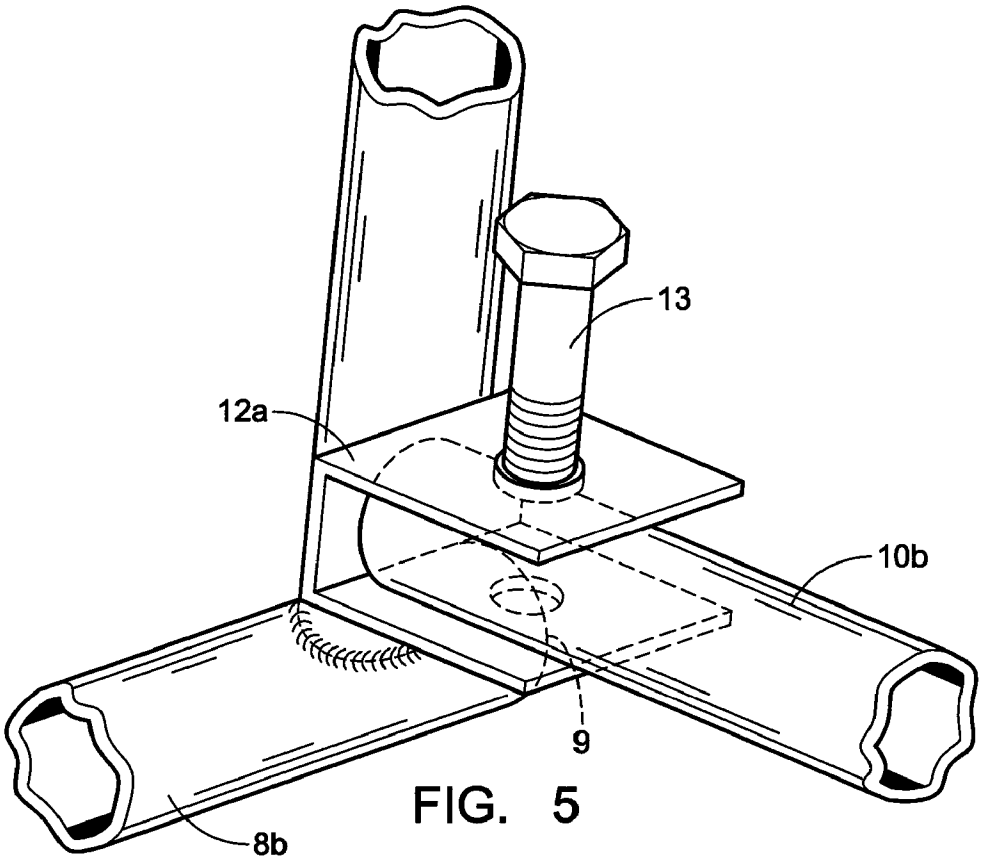
FIG. 5 is a diagram showing a collapsible boat boarding platform according to an embodiment of the present invention.
Figure 4:
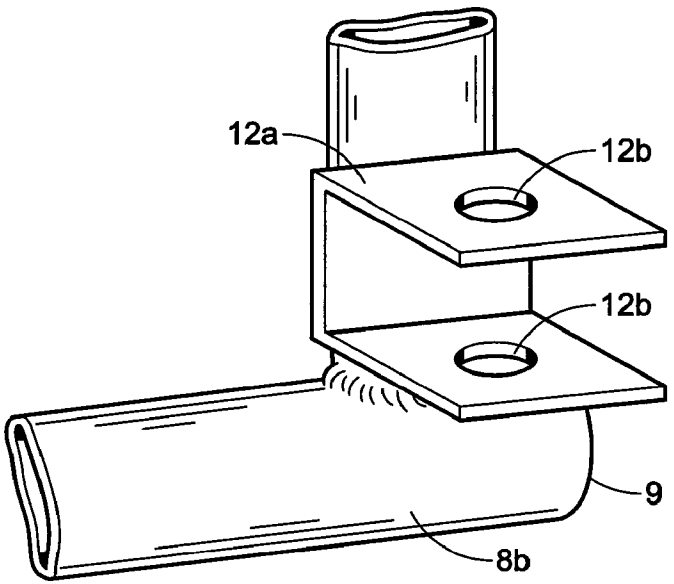
FIG. 4 is a diagram showing a collapsible boat boarding platform according to an embodiment of the present invention.
Figure 7:
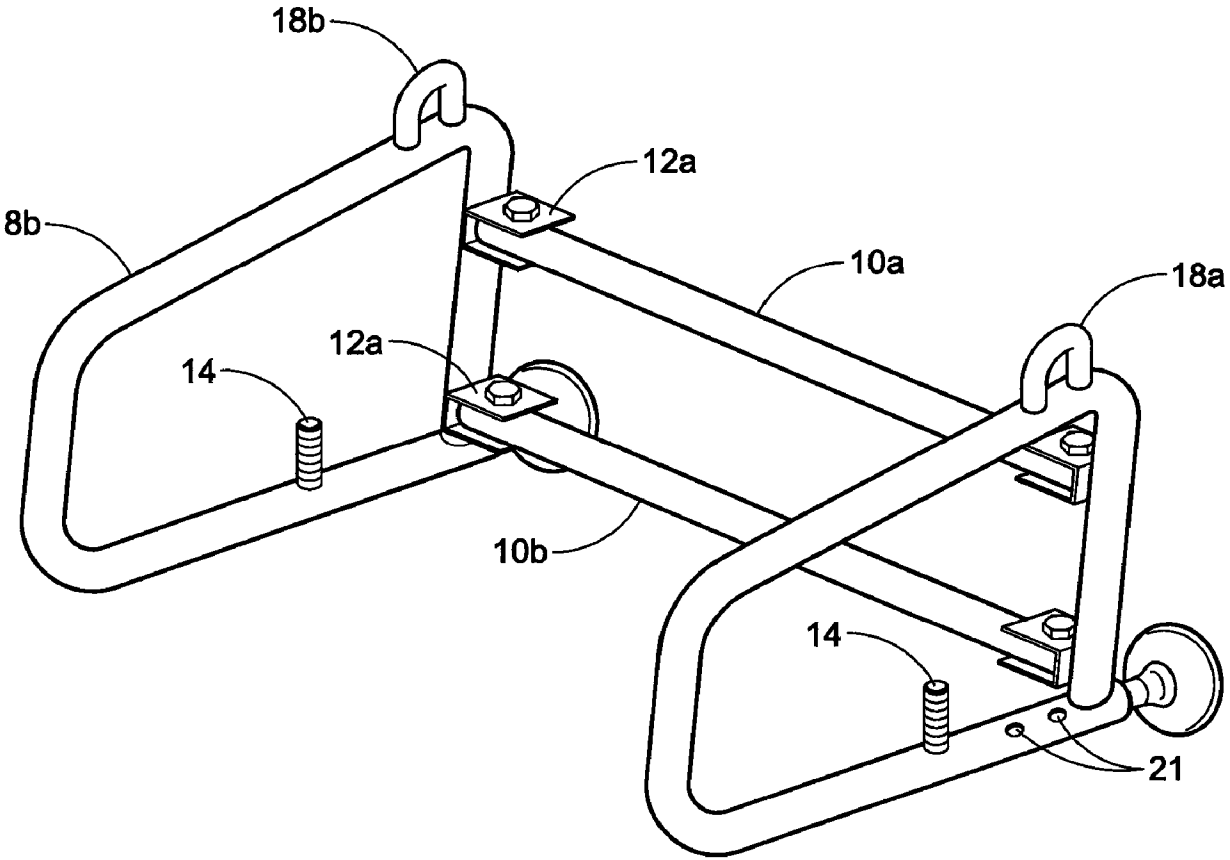
FIG. 7 is a diagram showing a collapsible boat boarding platform according to an embodiment of the present invention.
Figure 6:
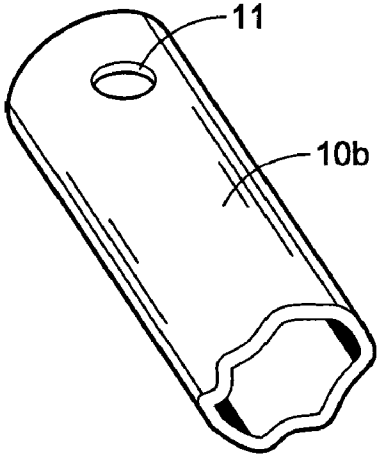
FIG. 6 is a diagram showing a collapsible boat boarding platform according to an embodiment of the present invention.

Referring now to the Figures, FIG. 2 is a diagram showing a collapsible boat boarding platform 29 according to an embodiment of the present invention. The collapsible boat boarding platform 29 includes two vertically extending tubular side panels 8*a* and 8*b*. The shape of each panel would be generally rectangular and made of steel or aluminum tubing. In one embodiment, the tubing is approximately ⅞" in diameter and is generally hollow inside. The length of both the vertical rearward upright and horizontal base, which extends in an outward direction and is essentially perpendicular with the vertical rearward upright, is approximately 16 inches.

Figure 8:
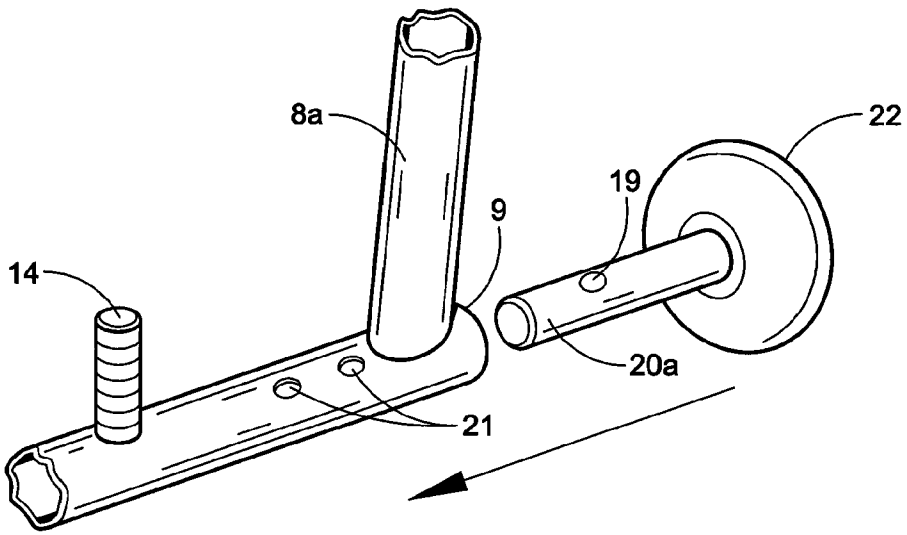
FIG. 8 is a diagram showing a collapsible boat boarding platform according to an embodiment of the present invention.

Referring now to FIG. 8, another diagram showing a collapsible boat boarding platform according to an embodiment of the present invention is shown. The tubing that makes up the two vertically extending tubular side panels 8*a* and 8*b* may be bent to shape, the lower rearmost corner of the panel is essentially horizontal and vertical.

An opening on a side of the lower rearmost corners of the two vertically extending tubular side panels 8*a* and 8*b* leaves the tubing with an adjustment rod opening 9 exposed. Into the adjustment rod opening 9 fits a sliding adjustment rod 20*a*. This rod is typically of a slightly lesser diameter than rod opening 9 as to fit into the opening. In one embodiment, the sliding adjustment rod 20*a* is about 10 inches long and made of steel or aluminum tubing.

To an opposing end of the adjustment rod 20*a* intercepting the rod opening 9 is affixed a suctioning member 22, such as a traditional suction cup. The adjustment rod 20*a* includes a conventional button lock 19 at a predetermined location. The button lock 19 is configured to intercept at least one adjustment rod locking hole 21 located on each of the vertically extending tubular side panels 8*a* and 8*b*. In the present example two locking holes are shown but more or less may be included as well.

Referring now to FIGS. 2, 5, 6, and 7, additional examples and/or components of a collapsible boat boarding platform are shown according to an embodiment of the present invention.

To connect the two vertically extending tubular side panels 8*a* and 8*b* for a complete framework for the collapsible boat boarding platform according to an embodiment of the present invention, a hinging member 12*a* is affixed to an upper and a lower portion of each of the vertically extending tubular side panels 8*a* and 8*b* at a determined location. In one embodiment, the hinging member 12*a* is facing inward toward each opposing vertically extending tubular side panels 8*a* and 8*b*.

In one example, there are four hinging members. Two connect to upper portions of the vertically extending tubular side panels 8*a* and 8*b* and two connect to lower portions. At the connections the hinging members also connect to a pair of frame back rails 10*a* and 10*b*, which intersect a frame hinge. In one example, the hinging member 12*a* is pivotably connected via the frame hinge and a pivot bolt 13, which partially protrudes through an upper and a lower hole in the frame hinge. Other configurations of a hinging member are also possible. The frame is now essentially complete and both of the vertically extending tubular side panels 8*a* and 8*b* are essentially at a 90 degree angle or perpendicular to the frame back rails 10*a* and 10*b*.

A step plate 24 may be lowered into position between the elongate openings in each side panel and above the most horizontal side panel tube and then aligned in a position for two threaded studs 14 to pass through two step plate mounting holes 25 to allow the step plate to lay firmly on the frame assembly. With the threaded stud protruding through the step plate mounting holes 25, a conventional threaded securing knob 16 may then be threadably engaged to the studs 14 and screwed down firmly.

As the frame components are preferably made of steel or aluminum, the step would also use one of these metals. However, wood or plastic may be more desirable for dissipation of heat from the sun or aesthetics.

Figure 9:
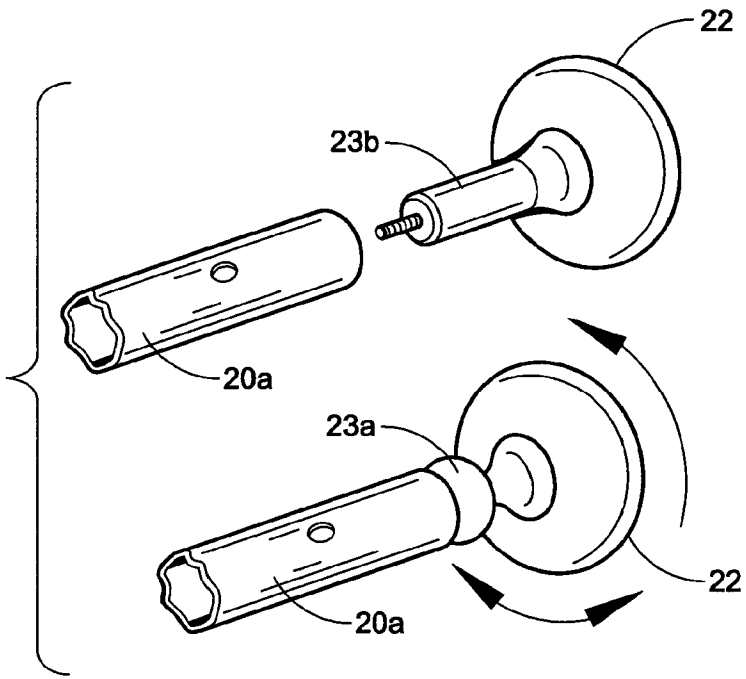
FIG. 9 is a diagram showing a collapsible boat boarding platform according to an embodiment of the present invention.

FIG. 9 is a diagram showing a collapsible boat boarding platform according to an embodiment of the present invention. FIG. 9 illustrates pivoting members 23A and 23B, which may be interposed between the adjustment rod 20*a* and the suctioning member 22. The pivoting members 23A and 23B may be any pivoting mechanism such as a ball joint, a flexible adjustment means, or the like. The pivoting member 23A is a conventional ball joint. The pivoting member 23B is a flexible adjustment material such as rubber. It is envisioned that one or both sides of the boarding platform would have a pivoting member depending on the boat configuration. The pivoting members 23A or 23B help to cause the boarding platform to affix securely to a boat that has a steep hull angle since the suctioning member 22 in this case will not meet the boat in a perpendicular manner without one.

Figure 1:
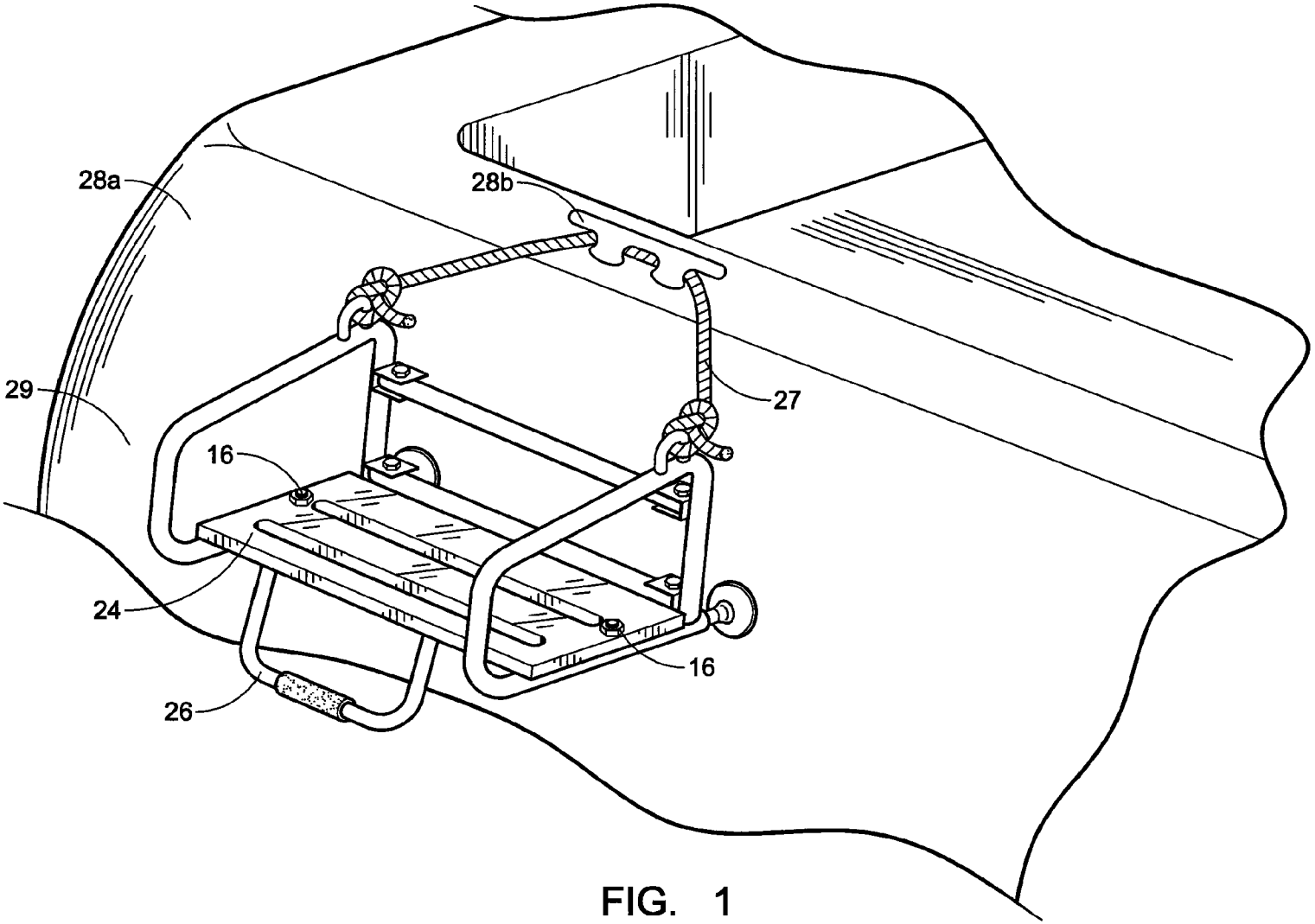
FIG. 1 is a diagram showing a collapsible boat boarding platform according to an embodiment of the present invention.
Figure 3:
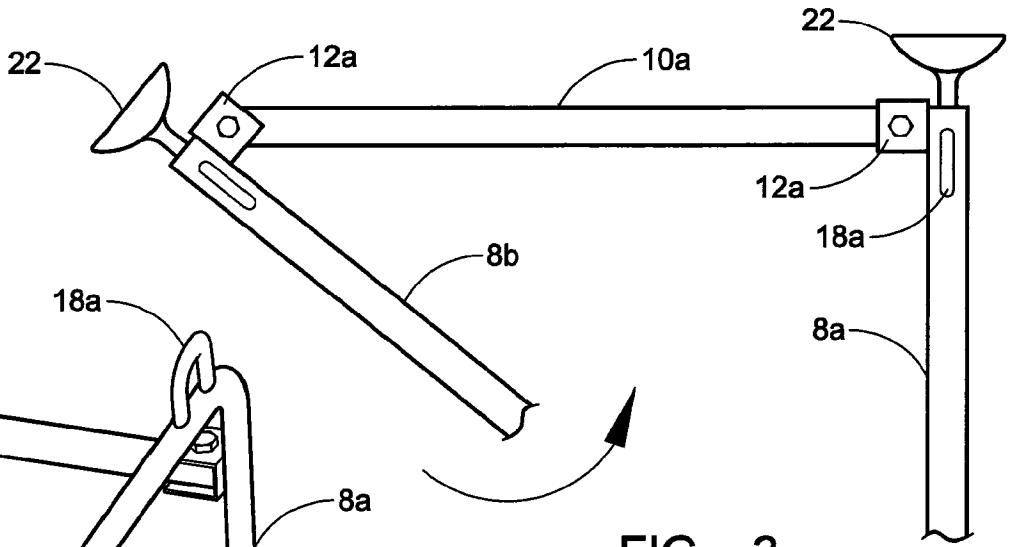
FIG. 3 is a diagram showing a collapsible boat boarding platform according to an embodiment of the present invention.

Referring now to FIG. 1, a conventional fold down ladder 26 may be installed to the outermost facing leading edge of the step plate 24 to assist in ascending the boarding platform. It is also envisioned that one or more padding members (not shown) may be included on the upper frame back rail 10*a*. For example, a first and second padding members, which are generally cylindrical in shape may be slid around each corner of the upper frame back rail 10*a* so that when the boarding platform presses against the hull of the boat, the boat is not scratched when a person embarks or disembarks. The collapsible boat boarding platform is now ready for operation.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A collapsible boat boarding platform comprising:

a first and a second vertically extending tubular side panel arranged in parallel to one another, a portion of each of the first and the second vertically extending tubular side panels extending in an outward direction and having an opening on a side opposite to the outward direction and at least a first locking structure in the outward direction;

first and second sliding adjustment rods having diameters which are smaller than the openings, each of the first and second sliding adjustment rods having first and second ends and at least a second locking structure thereupon, the first locking structure on the first vertically extending tubular side panel configured for engaging the second locking structure on the first sliding adjustment rod and the first locking structure on the second vertically extending tabular side panel configured for engaging the second locking structure on the second sliding adjustment rod;

an upper frame back rail having a first connection to an upper portion of the first vertically extending tubular side panel and a second connection to an upper portion of the second vertically extending tubular side panel, the first connection including a first hinging member disposed to pivot in an inward direction toward the second vertically extending tubular side panel and the second connection including a second hinging member disposed to pivot in an inward direction toward the first vertically extending tubular side panel;

a lower frame back rail having a third connection to a lower portion of the first vertically extending tubular side panel and a fourth connection to a lower portion of the second vertically extending tubular side panel, the third connection including a third hinging member disposed to pivot in an inward direction toward the second vertically extending tubular side panel and the fourth connection including a fourth hinging member disposed to pivot in an inward direction toward the first vertically extending tubular side panel;

a first and a second threaded stud, the first threaded stud located in the outward direction on the first vertically extending tubular side panel, the second threaded stud located in the outward direction on the second vertically extending tubular side panel; and a step plate having a first mounting hole on a first side of the step plate and a second mounting hole on a second side of the step plate, the first mounting hole configured to be aligned with the first threaded stud, the second mounting hole configured to be aligned with the second threaded stud.

2. The collapsible boat boarding platform of claim 1 wherein the first and second sliding adjustment rods include first and second suctioning members at the second ends opposite the first ends.

3. The collapsible boat boarding platform of claim 2 wherein the first and the suctioning members include first and second suction cups.

4. The collapsible boat boarding platform of claim 2 wherein the first and second sliding adjustment rods each includes a pivoting member proximate the suctioning member at the second end include a pivoting member between the first and second suctioning members at a second end opposite the end having the second locking means.

5. The collapsible boat boarding platform of claim 4 wherein the pivoting members include ball joints.

6. The collapsible boat boarding platform of claim 4 wherein the pivoting members include a flexible material.

7. The collapsible boat boarding platform of claim 6 wherein the flexible material comprises rubber.

8. The collapsible boat boarding platform of claim 1 wherein each of the first and the second hinging members further comprise:

a frame hinge having an upper and a lower opening; and a pivot structure connected to the upper and the lower openings.

9. The collapsible boat boarding platform of claim 1 further comprising first and second securing structures, the first securing structure configured to be threadedly engaged with the first threaded stud, the second securing structure configured to be threadedly engaged with the second threaded stud.

10. The collapsible boat boarding platform of claim 1 wherein the first and the second vertically extending tubular side panels, the first and the second sliding adjustment rods, the upper frame back rail, the lower frame back rail, the first and the second threaded studs, and the step plate are made from steel or aluminum.

11. The collapsible boat boarding platform of claim 1 wherein the first and the second vertically extending tubular side panels, the first and the second sliding adjustment rods, the upper frame back rail, the lower frame back rail, the first and the second threaded studs, and the step plate are made from metal.

12. The collapsible boat boarding platform of claim 1 wherein the step plate is made from wood or plastic.

13. The collapsible boat boarding platform of claim 1 further comprising a fold down ladder configured to be connected at a leading edge of the step plate.

* * * * *